US006895788B2

(12) United States Patent
Montgomery

(10) Patent No.: US 6,895,788 B2
(45) **Date of Patent: *May 24, 2005**

(54) APPLIANCE SAFETY VALVE ASSEMBLY

(75) Inventor: Danny K. Montgomery, Louisville, KY (US)

(73) Assignee: MCSM, LLC, Louisville, KY (US)

( * ) Notice: Subject to any disclaimer, the term of this patent is extended or adjusted under 35 U.S.C. 154(b) by 348 days.

This patent is subject to a terminal disclaimer.

(21) Appl. No.: 10/152,328

(22) Filed: May 21, 2002

(65) Prior Publication Data

US 2003/0005731 A1 Jan. 9, 2003

Related U.S. Application Data

(63) Continuation-in-part of application No. 09/651,163, filed on Aug. 30, 2000, now Pat. No. 6,389,852.
(60) Provisional application No. 60/151,462, filed on Aug. 30, 1999.

(51) Int. Cl.[7] ..... D06F 37/42
(52) U.S. Cl. ..... 68/12.02; 68/12.19; 68/207; 137/312; 137/360; 137/387
(58) Field of Search ..... 68/12.02, 12.19, 68/207, 12.16; 137/15, 312, 360, 387, 392, 624.11, 624.18

(56) References Cited

U.S. PATENT DOCUMENTS

| | | | | | |
|---|---|---|---|---|---|
| 2,542,279 | A | * | 2/1951 | Kempton | 137/606 |
| 2,949,759 | A | * | 8/1960 | Sisson | 68/12.23 |
| 2,997,062 | A | * | 8/1961 | Kozel et al. | 137/606 |
| 3,078,874 | A | * | 2/1963 | Kolze | 137/624.18 |
| 3,417,782 | A | * | 12/1968 | Mentnech | 137/624.11 |
| 5,000,224 | A | * | 3/1991 | Olson et al. | 137/624.12 |
| 6,164,319 | A | * | 12/2000 | Cochran et al. | 137/487.5 |

* cited by examiner

*Primary Examiner*—Frankie L. Stinson
(74) *Attorney, Agent, or Firm*—Carrithers Law Office, PLLC; David W. Carrithers

(57) ABSTRACT

A water supply safety valve kit for an appliance in which the kit includes an individual solenoid actuated normally closed valve unit for each water supply line to the appliance and a control unit that plugs into a conventional electrical female household outlet. The control unit has a first outlet at the household line voltage and into which the power cord of the appliance plugs and a second lower voltage outlet responsive to current flow to the first outlet. A count down timer circuit and a low voltage output are activated by the current flow to the first outlet and lines connect that low voltage output to the solenoid valve unit to open the same. The count down timer terminates the low voltage output after a preselected time period.

6 Claims, 8 Drawing Sheets

T = TRANSFORMER - 115V PRIMARY - 24V SECONDARY
C = CURRENT SENSING RELAY
B = BYPASS TIMER, 24V
R = SPST RELAY - 24V COIL NORMALLY OPEN

T = TRANSFORMER - 115V PRIMARY - 24V SECONDARY
B = BYPASS TIMER. 24V
R = SPST RELAY - 24V COIL NORMALLY OPEN
LVT = LOW VOLTAGE TERMINAL
R2 = 115V SINGLE POLE DOUBLE THROW

APPLIANCE SAFETY VALVE ASSEMBLY

This is a Continuation-In-Part of U.S. application Ser. No. 09/651,163 filed on Aug. 30, 2000 now U.S. Pat. No. 6,389,852 and claims priority from U.S. Provisional Application Ser. No. 60/151,462 filed on Aug. 30, 1999 both of which are incorporated by reference herein,

BACKGROUND OF THE INVENTION

1. Technical Field

The present invention relates generally to washing machines and more particularly to an improved water supply safety valve system.

2. Prior Art

Every year the insurance industry, as well as consumers, spend hundreds of millions of dollars repairing damage caused by ruptured or leaking washing machine water supply lines. These machines often are located in areas not frequently attended and thus the problem of a broken line can go unnoticed for considerable periods of time. There are other appliances that require water supplies for example a dishwasher to which the invention is applicable but the water leakage problem is less likely because of being located in a high traffic area and thus early detection unless of course the occupants are absent for long periods of time.

Water supply line shut off valves known to employ conventional control devices are disclosed in the following U.S. Pat. No. 5,782,263 granted Jul. 21, 1998 to G. Isacson Jr; U.S. Pat. No. 5,566,715 granted Oct. 22, 1996 to H. Griffin; U.S. Pat. No. 5,503,175 granted Apr. 2, 1996 to P. Ravilious; U.S. Pat. No. 5,409,037 granted Apr. 25, 1995 to J. Wheeler; U.S. Pat. No. 5,000,224 granted Mar. 19, 1991 to W. Olsen Jr; U.S. Pat. No. 4,877,049 granted Oct. 31, 1989 to P. Formasaari; U.S. Pat. No. 4,653,534 granted Mar. 31, 1987 to S. Chung-Shan; U.S. Pat. No. 4,589,435 granted May 20, 1986 to D. Aldrich; U.S. Pat. No. 3,880,190 granted Apr. 29, 1975 to G. Boss; U.S. Pat. No. 3,874,403 granted Apr. 1, 1975 to W. Fischer; and U.S. Pat. No. 3,850,199 granted Nov. 26, 1974 to A. Stone.

The foregoing references, along with the references listed as having been cited against the same, gives some indication of the numerous proposals made to solve the potential flooding problem.

The majority of the foregoing patented devices are fairly sophisticated devices that are complex and thus expensive to manufacture and/or require specialized installers. One of the simpler devices from an installation point of view is disclosed in the above patent U.S. Pat. No. 3,850,199 in that the automatic shut off unit is simply attached to the water supply faucet and the appliance hose is then connected to such unit. Internally the device has slidable pistons requiring accuracy in manufacturing and thus is somewhat costly from that point of view.

The foregoing patent U.S. Pat. No. 3,874,403 utilizes two solenoid operated valves i.e. one for cold water and one for hot water but they are mounted on a common housing and thus if one fails the entire unit must be replaced rather than just the faulty solenoid valve.

Moreover, because there are numerous washer installations that have never had a problem and therefore there is a reluctance to install flood preventing devices unless they are relatively inexpensive to buy, simple to install and easily and inexpensively repaired should that become necessary.

These prior art devices typically provide a supply of water to the appliance whereby once the washer or other appliance is activated the shut-off valve remains open for the entire duration of the wash cycle or use cycle. Contrary to the teachings of the prior art, the instant invention controls the flow of water to the appliance, whereby the timer starts over with each cycle, for instance a washer typically may use two (2) eight minute cycles, thereby preventing a flood in case the hose line to the appliance is damaged during the fill cycle.

SUMMARY OF THE INVENTION

The present invention is a kit comprising an individual solenoid actuated valve for each water supply line for the appliance at hand, (i.e. two for an automatic washing machine and one for a dishwasher or refrigerator ice maker), that connects in series with the water supply line(s) and a water supply line hose(s) for the appliance, a control unit that plugs into an electrical supply outlet in the vicinity of the appliance and has a first electrical outlet at the voltage of the supply outlet for connecting thereto the appliance power supply cord and a second electrical timer controlled outlet of lower voltage and means to connect the second outlet to the solenoid of the solenoid actuated valves. A control board in the control unit senses current flow to the washer when the latter is turned on and actuates the solenoid valves to open the same for each of the wash and rinse cycles. A timer circuit allows water to flow freely for a selected period of time. When the circuit times out the solenoid valves close preventing further water flow. The system is simple, easy to install and relatively inexpensive to manufacture and should a solenoid valve fail only the affected one needs to be replaced.

A preferred embodiment of the present invention is equipped with two electric solenoid valves that install on the incoming hot and cold water inlet valves. The washing machine hoses are then installed on the solenoid valves. Each valve is connected to a 12 volt control board by means of a two conductor control cord. The control board senses electrical current flow to the washing machine when it is being used. It then sends a signal to the solenoid valves to open. This allows water, for a set period of time, to flow to the washing machine. When the circuit times out, the solenoid valves close even though the washing machine may still be calling for water. Such an event may be when a water hose were to rupture not allowing the float valve in the washing machine or other appliance to stop the flow of water in its normal amount of time; or if the float valve were to malfunction. Flooding would result from either condition. In the present invention upon the circuit timing out, the valves would then stay closed until the next time the defective line to the appliance was repair and used. The instant invention virtually eliminates water damage repair problems in homes, apartments, condos, or the like due to appliance hose bursts or leaks.

Another preferred embodiment of the present invention is equipped with a single electric solenoid valves that install on the dishwasher or refrigerator ice maker inlet valves. The dishwasher and/or refrigerator ice maker hoses are then installed on the solenoid valves. Each valve is connected to a 12 volt control board by means of a two conductor control cord. The control board senses electrical current flow to the appliance when it is being used. It then sends a signal to the solenoid valves to open. This allows water, for a set period of time, to flow to the appliance. When the circuit times out, the solenoid valves close even though the appliance may still be calling for water. Such an event may be when a water hose were to rupture not allowing the float valve in the appliance to stop the flow of water in its normal amount of time; or if the float valve were to malfunction. Flooding would result from either condition. In the present invention upon the circuit timing out, the valves would then stay closed until the next time the defective line to the appliance was repair and used. The instant invention virtually eliminates water damage repair problems in homes, apartments, condos, or the like due to appliance hose bursts or leaks.

More particularly, an appliance safety valve assembly, comprising, a preferred embodiment of the present invention includes a solenoid controlled normally closed single valve unit having an inlet coupling and an outlet coupling. A control unit that plugs into a conventional household 110V AC power supply female outlet has a first female outlet thereon at the power supply voltage and into which the power supply cord for the washing machine can be plugged. The control unit has therein a circuit that includes a count down timer, a voltage step-down device selectively providing a low voltage output and means sensing current flow to the first power outlet. At the present time the low voltage output is set at less than 15 volts. Often a low voltage output is set at 12 volts. The low voltage output parameter of the instant invention is designed to coincide with the recommendations of the UL (Underwriters Laboratories, Inc.) recommended safety guidelines, safety standards, and safety requirements or other governmental or regulatory agency recommendations or equivalent entities in foreign countries. The low voltage output parameter may be higher or lower than 15 volts, but in any case the voltage is less than that required to operate the appliance (operating voltage) and maintain an increased margin of safety as compared to the appliance operating voltage. The low voltage output is activated in response to current flow to the first outlet detected by the current flow sensing means and deactivated by the count down timer. Means connecting the low voltage output to terminals of a coil portion of the solenoid of the valve unit are designed to open the normally closed valve upon detected current flow and close the same upon a preselected time lapse.

An object of the present invention is to provide an automatic water shut-off valve system that is simple to install, relatively inexpensive to manufacture as well as repair should that become necessary.

It is another object of the present invention to provide an automatic timed shut off.

It is another object of the present invention to be utilized in a wet environment to allow for a simple, easy, quick, installation of the kit without special tools or hardwiring or hard piping to the water and electrical sources.

It is another object of the present invention to utilize a voltage in compliance with UL listings of 15 volts or less for wet environment and preferably 12 volts.

It is another object of the present invention to provide a means to install the appliance safety valve assembly whereby the valves can be exposed for easy access due to the design incorporating low voltage actuators of less than 15 volts for safety.

It is another object of the present invention for the control unit to record the last fault code to make technical service and repair simple and inexpensive.

It is another object of the present invention to be able to replace the transformer with a step down switch.

It is another object of the present invention to develop a shut off safety valve which may be utilized with any model appliance.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

Figure 1:
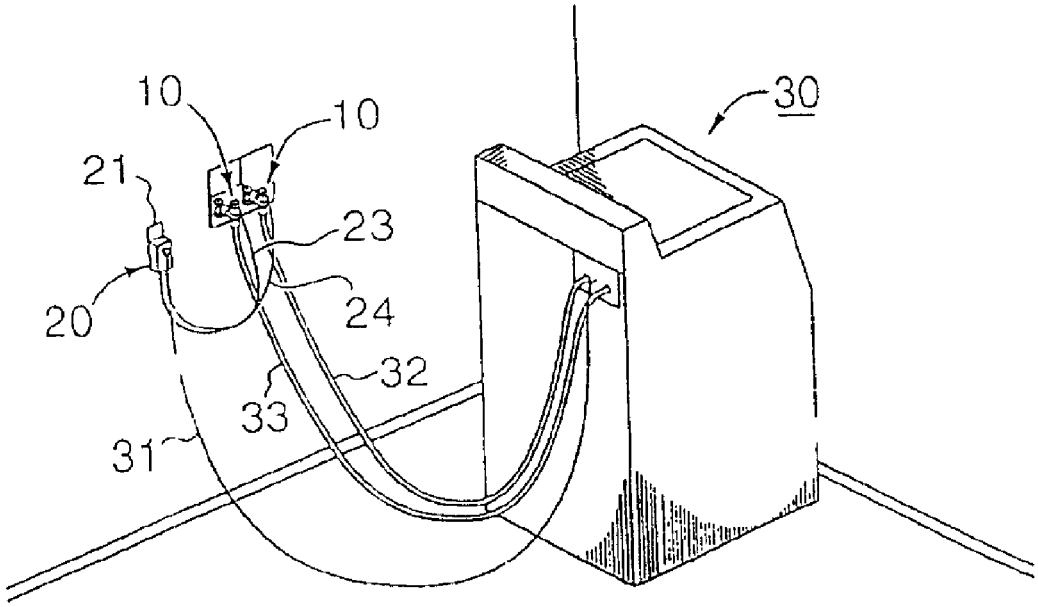
FIG. 1 is a perspective view of a washing machine connected to a power supply and water supply by a kit provided in accordance with the present invention.

The water supply appliance safety valve shut off assembly of the present invention comprises at least one solenoid actuated individual valve unit 10. A single valve is used for installation in a dish washer or refrigerator ice maker.

The following description is applicable to any electrical appliance utilizing pressurized water flow such as a refrigeator ice maker, a dish washer, and/or washing machine; however, the following example is set forth for installation in a washing machine which utilizes at least one unit and typically two units if hooked to independent cold and hot water supply lines. In the drawings two are shown one being connected to a hot water supply and the other connected to the cold water supply for an automatic washing machine 30, a control module 20 that plugs into an electrical power supply outlet 21 (110V AC) which is converted by a transformer or step down switch to less than 110 volts, and preferably 15 volts or less, and more preferably to 12 volts or less providing a low voltage power supply line to the solenoids of the respective valve units 10 making the instant invention the only water shut off device known to applicant which is in compliance with UL® listing.

Each solenoid valve unit 10 has a body 11 on which a solenoid 12 is mounted including a pair of electrical terminals designated respectively 13 and 14, for the coil portion of the solenoid. The valve body has couplings 15 and 16 at respectively the inlet and outlet of a fluid flow path through the valve such flows being designated by the respective arrows A & B. The valve in the flow path through the valve body is normally closed and kept in the closed position by the water line supply pressure. The valve is opened by applying a AC low voltage (12V) across the terminals 13 and 14.

The solenoid valve unit includes a body, bracket, coil, screen, diaphragm, guide, spring, armature, and screws to hold same together. The solenoid utilizes a pair of male couplings 15 which is preferably an internally threaded nut type ¾ inch coupling on the valve body that can be turned relative thereto and threaded on to the bib of a shut off valve 17 of the water supply and coupling 16 is preferably internally threaded so that the washer hose can be readily connected thereto. The couplings however may be a smooth sleeve type coupling that can be soldered, or in the case of a plastics material solvent welded, to a water supply line having a shut off valve in line therein. The couplings may be smooth, externally threaded, internally threaded or combinations thereof.

Figure 2:
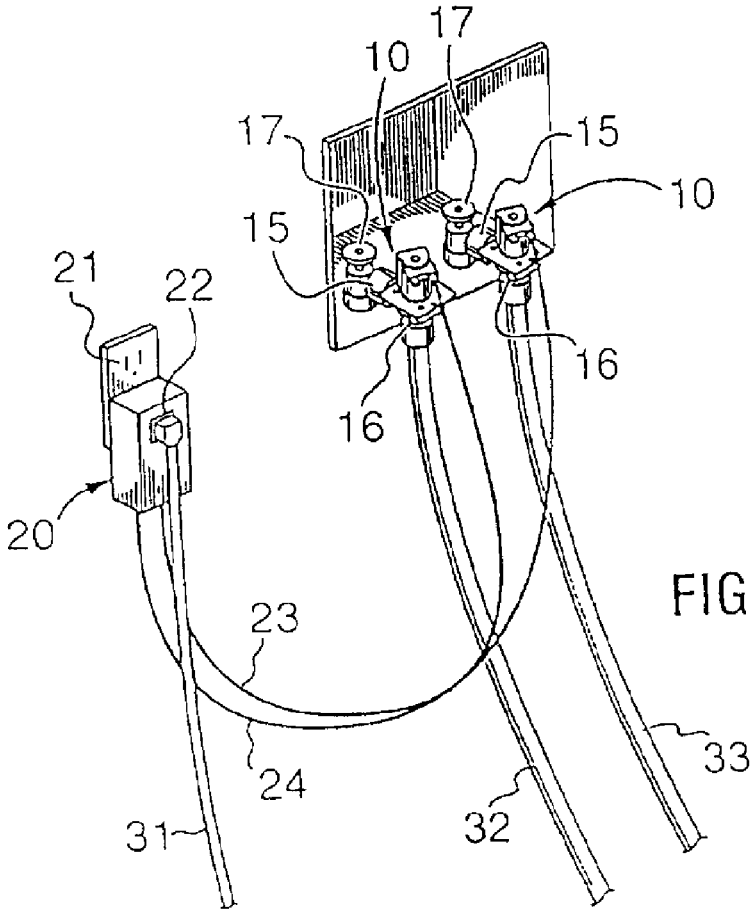
FIG. 2 is the same as FIG. 1 less the washing machine and on a larger scale.

The control unit 20 has conventional prongs (not shown) projecting therefrom that plug into the electrical supply female socket outlet 21 and such unit 20 has a first standard line voltage female socket 22 that the washing machine power cord plugs into and respective third and fourth low voltage output lines 23 and 24. Each line 23 and 24 is a two wire line that connects by way of end connectors to the solenoid terminals 13 and 14 of the solenoid actuated valve associated therewith line 23 in FIG. 2 being shown connected to solenoid of the hot water supply and line 24 to the cold water supply.

The washing machine respective hot and cold water supply hoses 32 and 33 are connected to the externally threaded coupling 16 on the outlet side of the respective solenoid valve for the hot and cold water taps.

The control unit has a step down transformer providing a 24V AC output, a line current sensing relay and a timer circuit that can be provided in many different forms by anyone skilled in the art to perform the functions to be described hereinafter.

Figure 3:
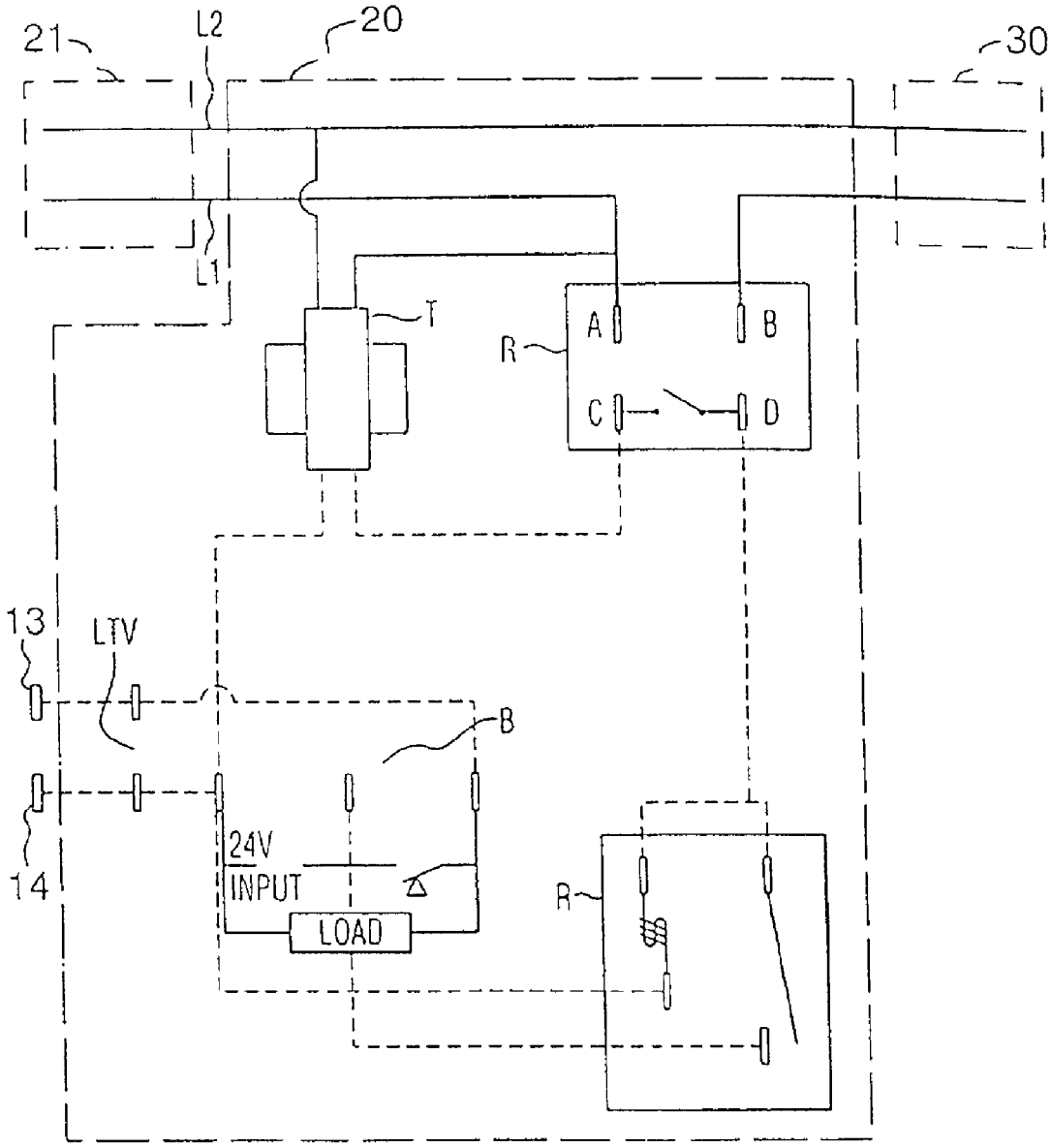
FIG. 3 is a wiring schematic of the control unit.

Referring to electrical schematic in FIG. 3 the washing machine 30 is connected to 110 V AC power supply lines L1, L2 through the control unit 20 which has a current sensing relay C, a step down transformer T, a bypass 24 V timer B and a single pole single throw normally open relay switch. A step down switch can also be substituted for the transformer T.

Figure 4:
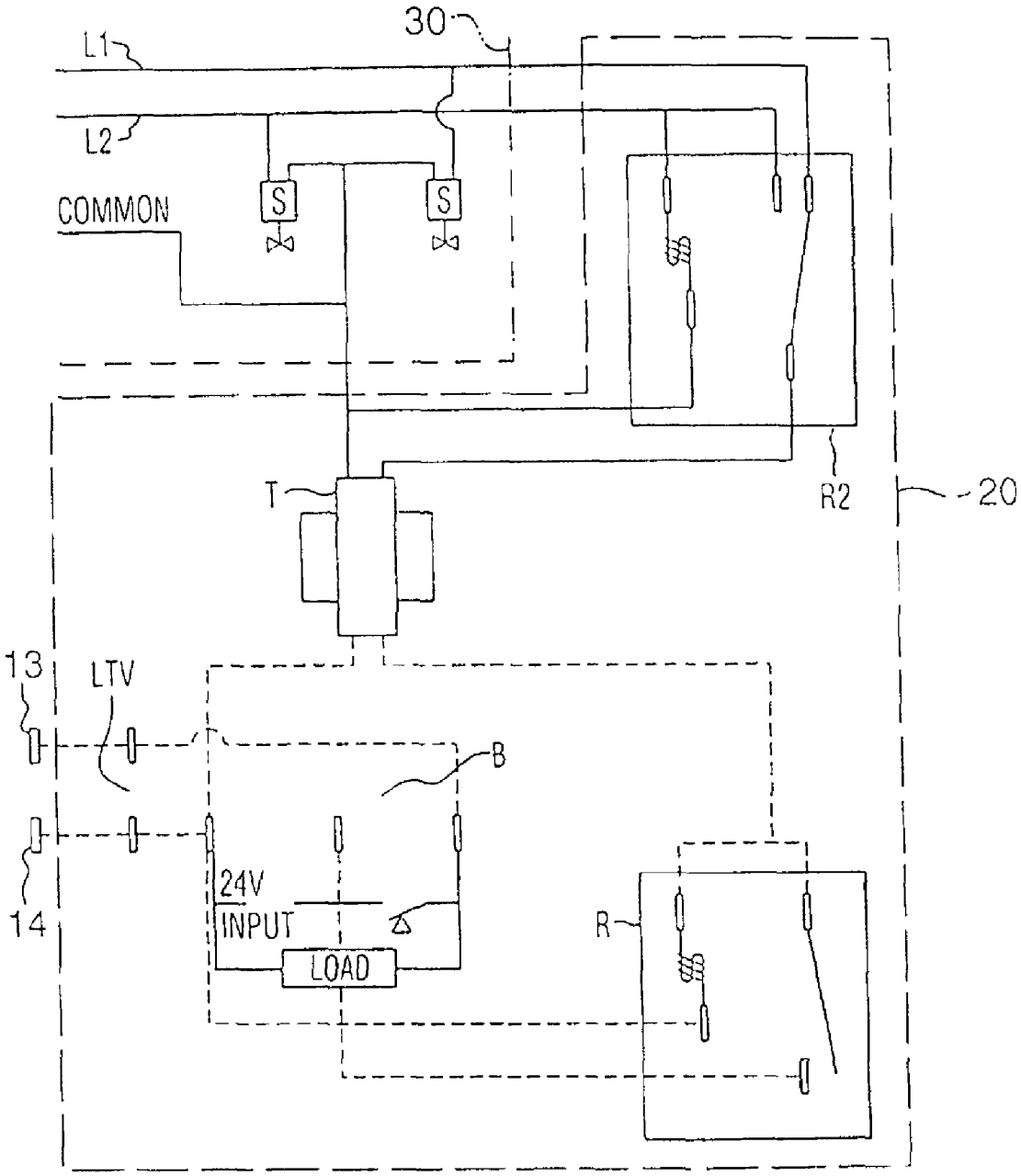
FIG. 4 is an alternative wiring schematic for the control unit.
Figure 5:
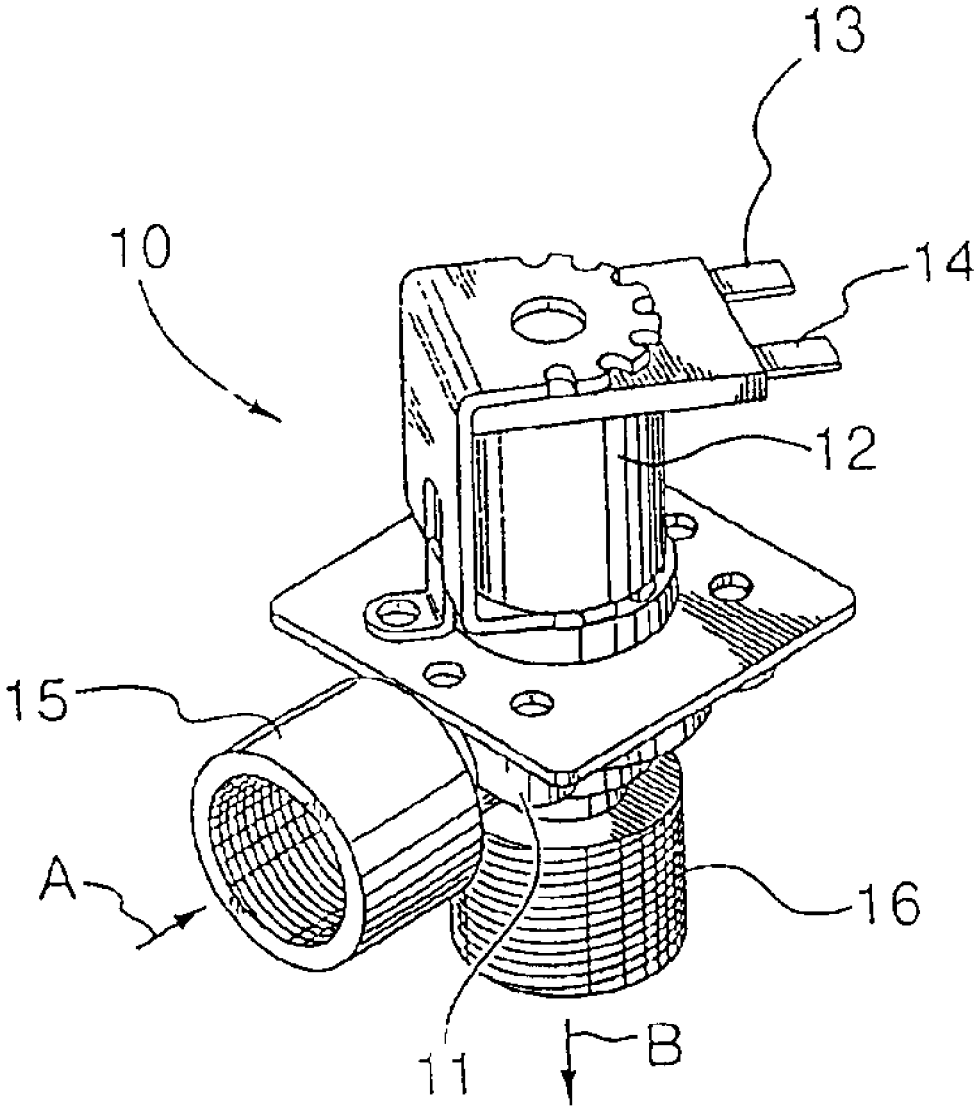
FIG. 5 is an oblique view of an individual solenoid actuate valve.
Figure 6:
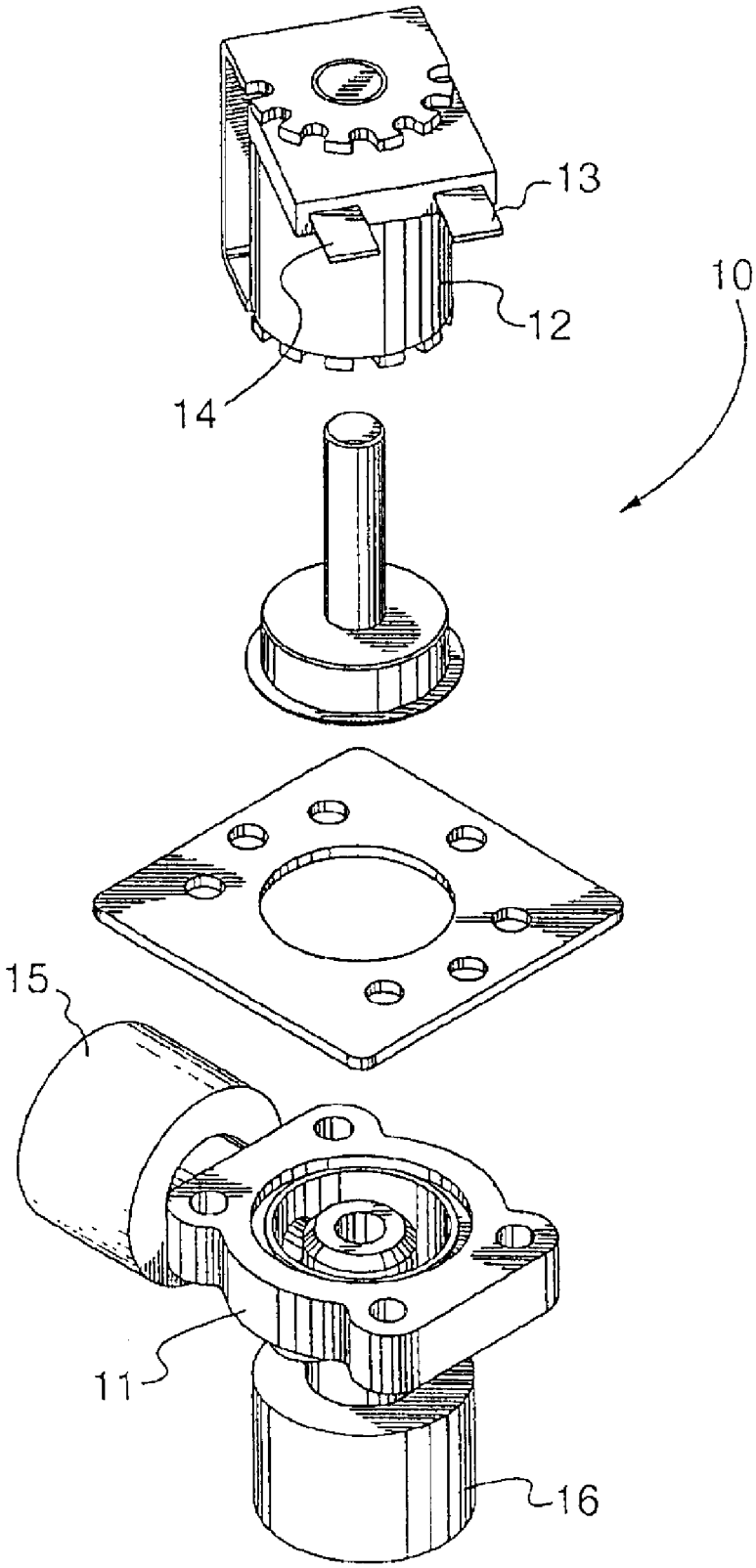
FIG. 6 is an exploded view showing the solenoid actuate valve of FIG. 5.

In the embodiment of FIG. 4, the step down transformer T is connected to the washer solenoid valves and the current sensor R2 being a double throw single pole relay R2. The transformer provides 12V AC to the solenoid terminals through a single pole single throw normally open relay R and a bypass timer B.

When the washer timer is engaged, starting the operation of the washer 30, a signal goes out to the hot and/or cold water solenoid valves 10 as the case maybe. Current flowing through the washer power cord 31 is detected and activates the timer B and causes the solenoid valves 10 to open whereby water flows to the washer as required by the washing machine control. The timer allows the solenoid valves to remain open for a set period of time after which the solenoid valves close whether or not there is a demand for water by the washer. The washer signal may be caused by a number of conditions such as (a) the water hose 32 or 33 leaking, whereby the washer 30 will continue to call for water but will not fill the washer tub as quickly, thus causing flooding damage; or (b) the washer float valve malfunctions whereby the washer tub will overfill causing flooding and water damage.

At the end of the wash cycle current flowing through the control unit 20 ceases because the washer timer control (not shown) ceases to call for any action. When the washer timer reaches the rinse cycle the process described starts again. There are only four conditions that will start or restart the cycle again. The first is manually starting the washer. The second is automatically done by the washer at the start of the rinse cycle. The third is manually shutting off the washer and then restarting the same. The fourth condition is due to a power outage or interruption in the main power supply.

As previously mentioned the solenoids 10 operate on 12V AC but obviously other low voltages could be used as long as the low voltage current remained compliant with UL listings or other suggested safe wet environment regulations set forth by governmental regulatory agencies. Also, the low voltage circuit can be fused as a safety precaution. The schematics in FIGS. 3 & 4 illustrate current flow dependent relays but obviously other equivalent means such as diodes, printed circuit boards, may be used as will be readily understood by those skilled in the art.

In FIG. 4, the washing machine 30 is shown with the conventional solenoid controlled water valves S. The transformer is connected to these valves and a 115V single pole double throw relay R2. When the washer timer is engaged starting operation of the washer 30 a signal goes to the washer hot and cold water solenoid valves s. The current then flows through an isolating relay to the transformer T. This causes the bypass timer B to start the timing sequence which causes the solenoid valves 10 to open for a set period of time. After the set time expires the solenoid valves 10 close whether or not the washer is calling for water. This condition maybe caused by the water supply hoses 31 and 32 leaking.

At the end of the wash cycle the current flowing through the control panel ceases because the washer cycle timer is not calling for any action. When the washer timer is automatically engaged for the rinse cycle the process described above starts again.

It is contemplated that a computer monitoring device may also be connected to the present invention to record cycles, interruptions, and even activate an alarm in electrical communication with the solenoids. Also a simple programmable controller could be used to vary the cycle times of the appliance safety valve circuit in accordance with selected time limits for special applications.

Installation of the present invention is simple. For instance, to install in a washing machine turn the hot and cold water valves off. Disconnect the hot and cold water supply hoses from the water valves. Unplug the washing machine power cord. Connect the inlet side of the hot and cold water solenoid valves to the hot and cold water valves where the washing machine water supply hoses are connected. Connect the washing machine water supply hoses to the outlet side of the hot and cold water solenoid valves. Connect the two electrical cords from the control box to the hot and cold solenoid valves. Plug the control box into the 115 volt wall outlet where the washing machine is plugged in and then plug the washing machine power cord into the control box. Open the hot and cold water valves and check for leaks. The washing machine may then be operated as normal.

An alternate embodiment of the present invention is designed for use with an ice maker or dish washer. One 110 volt solenoid valve is installed directly on the manual water valve for the ice maker or dishwasher. A water feed tube is installed to the solenoid water valve. Two (2) 110 volt leads with piggy back spade clips are run and connected to the ice maker water valve in the refrigerator or water valve in the dish washer. This allows water to be tuned on and off automatically at the source when the refrigerator ice maker or dish washer calls for water. The water feed tube from the solenoid valve could still leak, but only during ▩on▩ time when the appliance calls for water which is typically 6 to 10 seconds and under low water pressure due to the valve in the appliance being open at the same time. To connect the piggy back spade clips, simply unplug the refrigerator and remove the lower back cover of the refrigerator. Remove the two wires from the valve by pulling the spade clips from the spade terminals. Push the two piggy back spade clips onto the two water valve terminals and then put the two spade clips which were removed from the valve onto the piggy back spade terminals. More particularly, the signal for the water to the dishwasher valve starts the timer that opens the dishwasher safety valve for a set period of time. If the dishwasher safety valve times out before the dishwasher valve signal stops, the dishwasher safety valve closes until the dishwasher is restarted.

Figure 7:
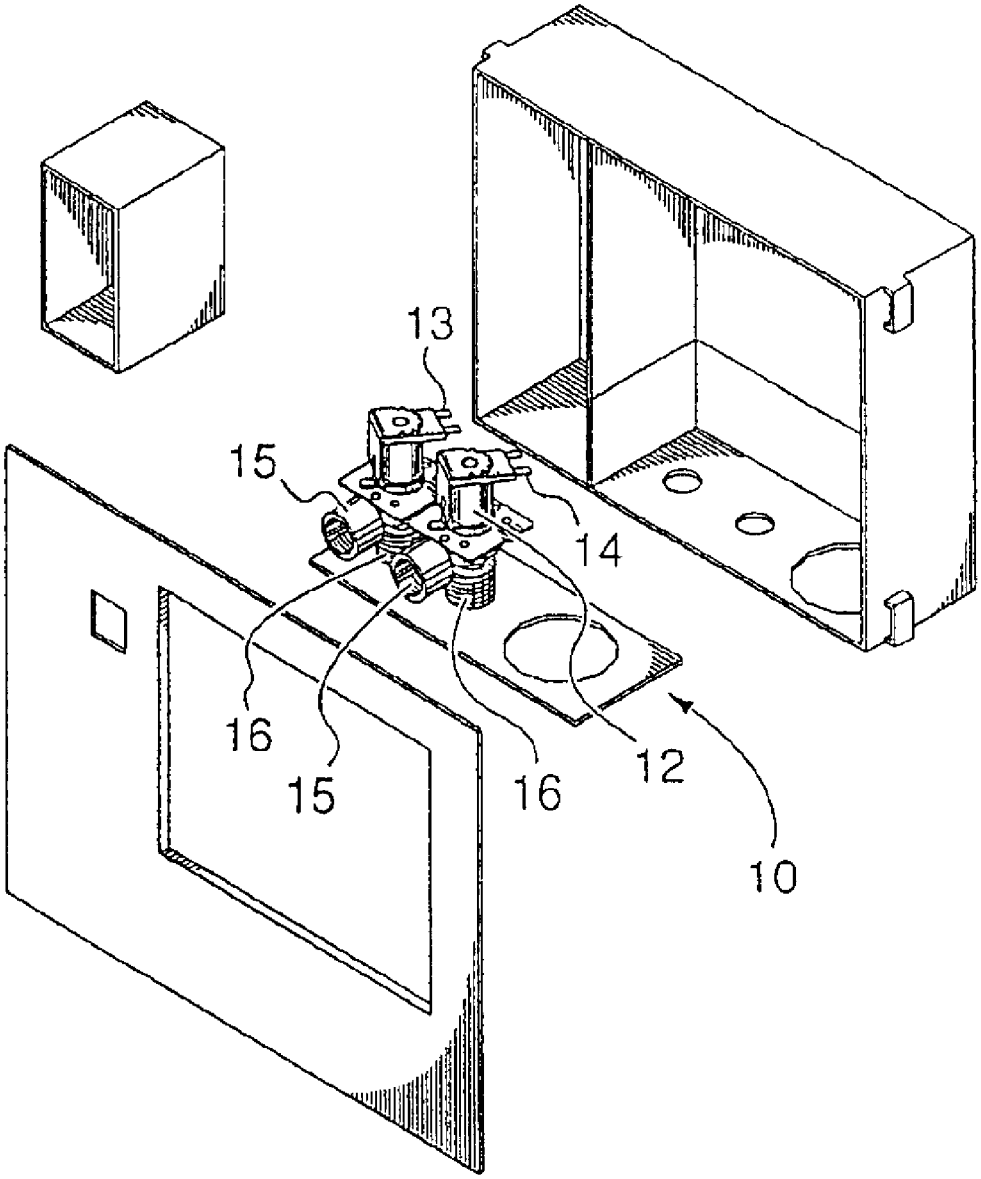
FIG. 7 is an exploded view showing a box for new construction mounting defining an enclosure having a face plate and back wherein the the solenoids and control unit are contained therein ready for wiring to an existing standard electrical receptacle.
Figure 8:
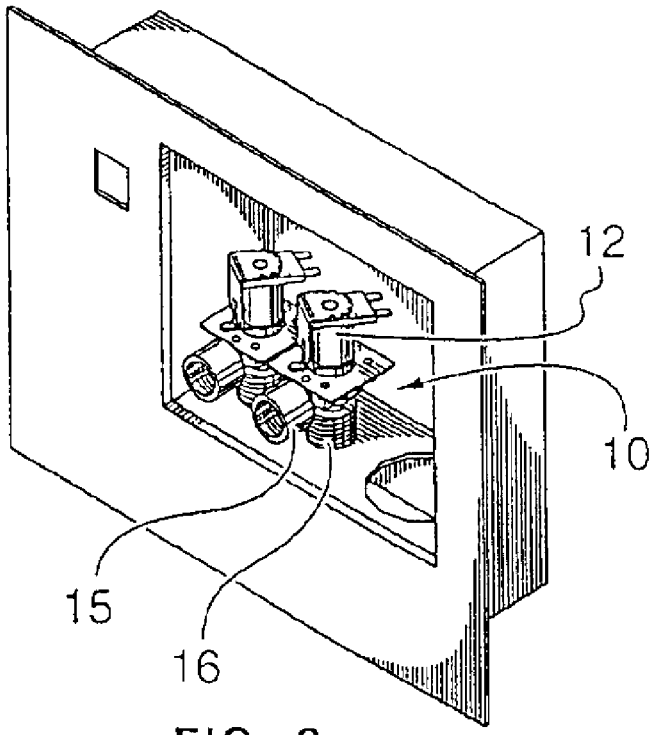
FIG. 8 is a perspective view of FIG. 7, showing a complete box unit ready for installation onto or within a wall.
Figure 9:
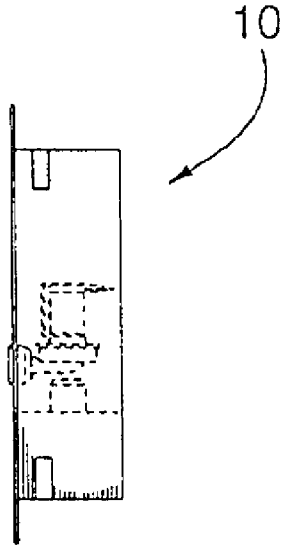
FIG. 9 is a side view of the box unit wherein the electrical connections can extend from the back of the box and plug directly into an existing wall socket for easy installation.
Figure 10:
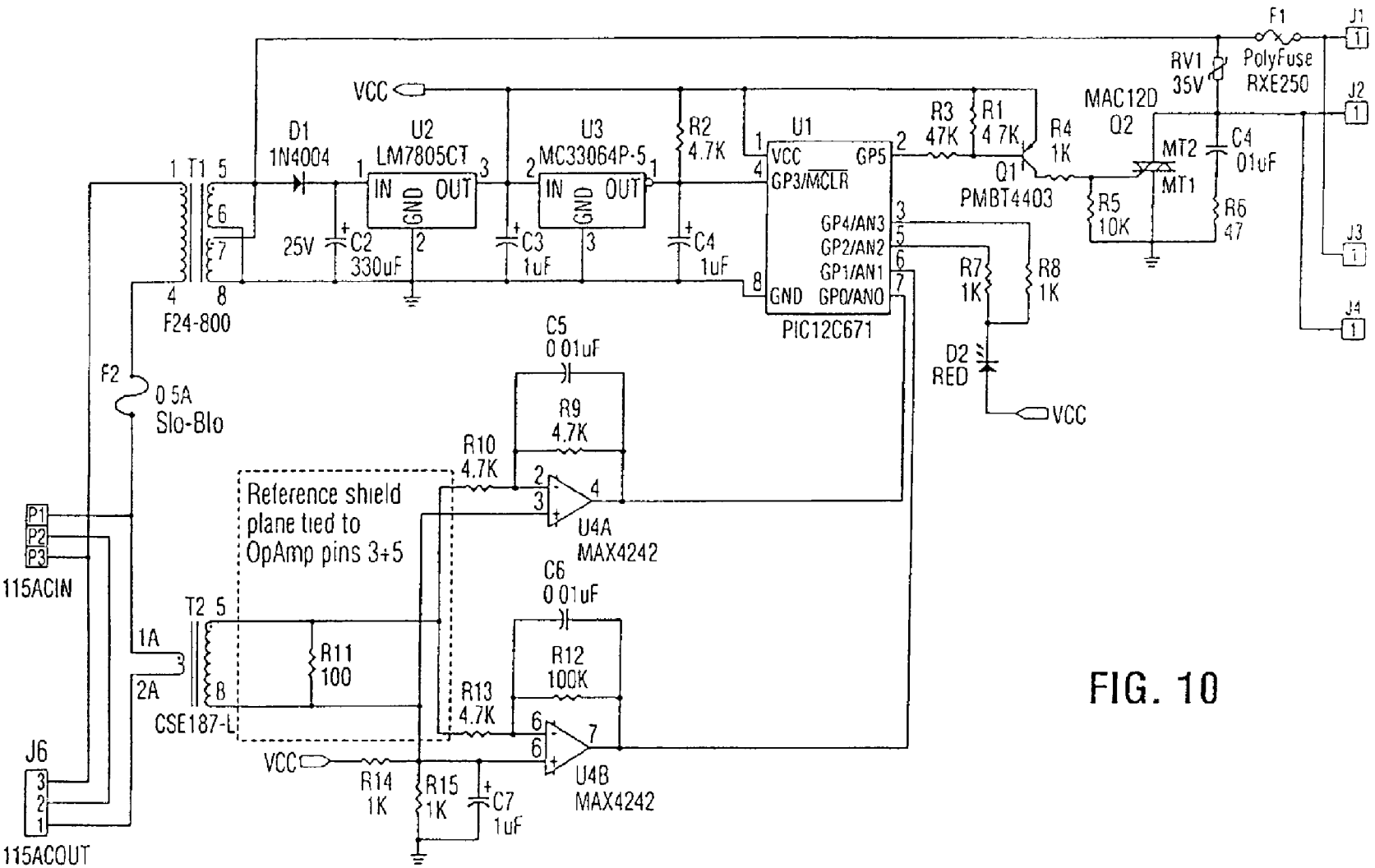
FIG. 10 is a wiring schematic including the components for a preferred embodiment of the control unit which includes a microprocessor.

FIGS. 7 and 8 show views of a kit for new construction mounting defining an enclosure having a removable face plate and back wherein the the solenoids and control unit are contained therein ready for wiring to an existing standard electrical receptacle. The box may be mounted onto a wall, but preferably is designed to be recessed within the wall between studs.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. An appliance safety valve assembly, comprising, (a) a solenoid controlled normally closed single valve unit having an inlet coupling and an outlet coupling;

(b) a control unit that plugs into a conventional household 110V AC power supply female outlet and having a first female outlet thereon at said power supply voltage and into which the power supply cord for the appliance can be plugged, said control unit having therein a circuit that includes a count down timer, a voltage step-down device selectively providing a low voltage output of less than the operating voltage of the appliance, and means sensing current flow to said first power outlet, said low voltage output being activated in response to current flow to said first outlet detected by said current flow sensing means and deactivated by said count down timer; and (c) means connecting said low voltage output to terminals of a coil portion of the solenoid of said valve unit to open said normally closed valve upon said detected current flow and close the same upon a preselected time lapse.

2. A kit as defined in claim 1, wherein said low voltage output is up to 15 volts.

3. A kit as defined in claim 1 wherein the appliance is a washing machine and wherein said kit includes an individual solenoid actuated valve unit for each of the hot and cold water supply outlets for the washing machine.

4. A kit as defined in claim 3 wherein said valve inlet and outlet couplings are respectively internally and externally threaded couplings.

5. An appliance and appliance safety valve assembly, comprising, (a) an appliance selected from the group consisting of a washing machine, a dish washer, and a refrigerator ice maker;

(b) at least one solenoid controlled normally closed single valve unit having an inlet coupling and an outlet coupling;

(c) a control unit that plugs into a conventional household 110V AC power supply female outlet and having a first female outlet thereon at said power supply voltage and into which the power supply cord for the washing machine can be plugged, said control unit having therein a circuit that includes a count down timer, a voltage step-down device selectively providing a low voltage output of less than the appliance operating voltage and means sensing current flow to said first power outlet, said low voltage output being activated in response to current flow to said first outlet detected by said current flow sensing means and deactivated by said count down timer; and (d) means connecting said low voltage output to terminals of a coil portion of the solenoid of said valve unit to open said normally closed valve upon said detected current flow and close the same upon a preselected time lapse.

6. A kit as defined in claim 1, wherein said low voltage output is up to 15 volts.

* * * * *